United States Patent [19]

Deguchi et al.

[11] Patent Number: 4,531,823

[45] Date of Patent: Jul. 30, 1985

[54] ELECTROSTATIC COPYING MACHINE HAVING REMOVABLE PAPER PATH

[75] Inventors: Yutaka Deguchi, Himeji; Rikuzou Kouzuki, Kasai; Daiwa Iinuma, Kasai; Kenhachi Shiraki, Kasai; Kiyoshi Sakamoto, Kanzaki; Kunio Tsuboi, Kasai; Yoshitaka Shibata, Taka, all of Japan

[73] Assignee: Sanyo Electric Co., Ltd., Japan

[21] Appl. No.: 447,194

[22] PCT Filed: Mar. 31, 1982

[86] PCT No.: PCT/JP82/00089

§ 371 Date: Dec. 6, 1982

§ 102(e) Date: Dec. 6, 1982

[87] PCT Pub. No.: WO82/03702

PCT Pub. Date: Oct. 28, 1982

[30] Foreign Application Priority Data

| | | | |
|---|---|---|---|
| Apr. 17, 1981 | [JP] | Japan | 56-58818 |
| Apr. 17, 1981 | [JP] | Japan | 56-58819 |
| May 19, 1981 | [JP] | Japan | 56-72822 |
| May 19, 1981 | [JP] | Japan | 56-72823 |
| May 19, 1981 | [JP] | Japan | 56-075964 |
| Aug. 20, 1981 | [JP] | Japan | 56-123906 |
| Sep. 1, 1981 | [JP] | Japan | 56-130629 |
| Sep. 4, 1981 | [JP] | Japan | 56-132446 |

[51] Int. Cl.[3] ..... G03G 15/00; G03G 15/22; B65H 31/22; B65H 5/02

[52] U.S. Cl. ..... 355/3 R; 355/3 SH; 355/3 TR; 355/3 TE; 355/3 CH; 271/8.1; 271/207; 271/213; 271/293

[58] Field of Search ..... 355/3 R, 3 DD, 3 P, 355/3 BE, 3 DR, 3 FU, 3 SC, 3 SH, 3 CH, 3 TE, 3 TR, 8, 11, 14 R; 271/8 R, 207, 213, 293

[56] References Cited

U.S. PATENT DOCUMENTS

| | | | |
|---|---|---|---|
| 3,632,201 | 1/1972 | Granzow et al. | 355/3 SH |
| 3,997,262 | 12/1976 | Doi et al. | 355/8 X |
| 4,017,169 | 4/1977 | Komura et al. | 355/3 R |
| 4,021,108 | 5/1977 | Ozaki et al. | 355/3 R |
| 4,116,429 | 9/1978 | Van Buskirk et al. | 271/293 X |
| 4,116,556 | 9/1978 | Tanaka et al. | 355/3 SH |
| 4,275,876 | 6/1981 | Imaizumi | 355/3 SH X |

*Primary Examiner*—A. T. Grimley
*Assistant Examiner*—Terry Flower
*Attorney, Agent, or Firm*—Darby & Darby

[57] ABSTRACT

An electrophotographic copying machine includes a photosensitive drum on which an electrostatic latent image is formed, a developing apparatus for developing the electrostatic latent image into a toner image, a transferring apparatus for transferring the toner image to a copy paper supplied from a paper supplying portion, a fixing apparatus for heating the copy paper having the toner image transferred thereto to fix the toner image, and a paper ejecting roller for ejecting the copy paper having the toner image fixed thereto to the exterior of the machine body. The copying machine elements are arranged so that the copy paper transporting path from the paper supplying portion to the paper ejecting portion is divided into two assembly units, the assembly units which can be removed from respective predetermined attached positions toward the exterior of the copying machine body in a direction opposite from each other and parallel to the transporting direction of the copy paper.

23 Claims, 15 Drawing Figures

ELECTROSTATIC COPYING MACHINE HAVING REMOVABLE PAPER PATH

FIELD OF THE ART

The present invention, generally, relates to an electrophotographic copying machine. More particularly, the present invention relates to an improvement in the structure of an electrophotographic copying machine adapted to expose a photosensitive drum to light to form an electrostatic latent image, to develop the electrostatic latent image by means of a toner in a developing apparatus, to transfer the toner image to a copy paper fed from a copy paper storing portion, to fix the toner image transferred on the copy paper, and thereafter to eject the copy paper to the exterior of the machine body.

BACKGROUND ART

One of prior arts of interest to the present invention is disclosed in Japanese Utility Model Laying-Open Gazette No. 153240/1979 (which corresponds to U.S. Pat. No. 4,275,876, issued June 30, 1981). This prior art is an electrophotographic copying machine structured such that a part of a copy paper transporting path from a paper supplying portion to a paper ejecting portion is made into one unit and the unit is structured in a manner capable of being drawn in the copy paper transporting direction from the copying machine main body. More specifically, this prior art is structured such that most of the copy paper transporting path including a transferring portion, a fixing portion and a paper ejecting roller, a copy paper storing portion and a paper supplying roller, is made into one unit. And, the same is adapted such that, when a paper jam (a jam) occurs at a part of the copy paper transporting path, the unit is drawn in the copy paper transporting direction, whereby the copy paper having caused the paper jam is easily taken out. However, in this prior art, the paper supplying roller remains attached to the copying machine main body side, since it is impossible to draw all of the copy paper transporting path including a paper supplying cassette for the reason to be described subsequently. Accordingly, on the occasion of a paper jam having occurred in the close vicinity of a paper supplying end, it is necessary to insert a hand into the vicinity of the photosensitive drum to draw out the copy paper in the direction perpendicular to the transporting direction. Such is not different from the conventional devices having been known prior to this prior art, and such involves a possibility of injuring the photosensitive drum or a sufficient possibility of touching the photosensitive drum by the hand. Accordingly, in this prior art, there remains the drawback of the conventional arts, that is, the possibility of injuring the photosensitive drum or of touching the photosensitive drum on the occasion of taking out the copy paper having caused the paper jam, and it is impossible to say that an entire improvement has been made compared to the conventional arts.

Another example of the prior art described in Japanese Patent Laying-Open Gazette No. 12335/1978, laid open on Feb. 3, 1978. In this prior art, differing from the above described prior art, a part of the copy paper transporting path from the paper supplying portion to the photosensitive drum is made into an integrated unit, and the unit is structured to be capable of moving in the direction parallel with the radial direction of the photosensitive drum, or the copy paper transporting direction. This other prior art also relates to an improvement in making it easy the copy paper on the occasion a paper jam. However, in this prior art, since it is impossible to draw portions other than the paper supplying portion, it is necessary to insert a hand into the interior of the main body as before on the occasion of the paper jam at portions of a developing apparatus or a drying roller, whereby there is a great probability of touching the photosensitive drum. Meanwhile, in this prior art, it is impossible to make the transporting path and the paper supplying portion as a unit and to draw the unit. The reason is that the copying machine described in Japanese Patent Laying-Open Gazette No. 12335/1978 is adapted to make liquid development, whereby the developer is split on the occasion of the developing apparatus portion being structured to move, and, therefore, this prior art does not teach or suggest anything about the movement of transporting path portions other than the paper supplying portion at all.

It is believed that the above described two prior art devices are most closely related to the present invention. However, as described above, both of the two prior art devices still have the shortcomings of the conventional art devices which were already known prior to the two prior art devices. More specifically, both of the two prior art devices are not structured such that all of the copy paper transporting path can be withdrawn to the exterior of the machine body, and, therefore, there is a high probability that a hand of a person will come into contact with the photosensitive drum and damage it. The photosensitive drum used in the electrophotographic copying machine, in general, must not be touched by a human hand. The reason is that the performance of sensing light extremely deteriorates when fat on a human hand adheres to the surface of the photosensitive drum. Accordingly, in the electrophotographic copying machine using such a photosensitive drum, there must not be a possibility of the human hand coming into contact with the photosensitive drum, at all.

Accordingly, a primary object of the present invention is to provide an electrophotographic copying machine in which there is no danger that a human hand may come into contact with the photosensitive drum or damage the photosensitive drum removing a copy paper jammed in the machine.

The electrophotographic copying machine in accordance with the present invention is structured such that the copy paper transporting path from the paper supplying end to the paper ejecting end is divided into two assembly units, each of the assembly units being capable of being drawn from a predetermined attached position at the exterior of the machine body in a direction opposite from each other and a parallel with the transporting direction of the copy papers. According to the present invention, since the copy paper transporting path is divided into two assembly units and one or both of the assembly units can be withdrawn due to the structure permitting the removal of each of the assembly units to the exterior of the machine body, there is no necessity to insert a hand into the main body and thus there is no danger that a human hand will come into contact with the photosensitive drum on the occasion of a paper jam in any portions of the copy paper transporting path. In order to eliminate the possibility that a human hand will come into contact with the photosensitive drum, all of the transporting path is structured to be withdrawn at one side of the machine body in the direction parallel to the copy paper transporting path. However, in the case where all of the transporting path is structured to be drawn as one unit, it is necessary to structure the machine body or the transporting path unit to be very strong and thus the size of a machine must be large. Therefore, the entire copying machine becomes extremely heavy, since a large moment occurs on the occasion of withdrawing the assembly and a particularly very large moment occurs on the occassion of withdrawing all of the unit. In addition, on the occasion of withdrawing the transporting path, the position of the center of gravity of the copying machine shifts outside the machine main body, so that there is the danger that the entire machine will fall down. In contrast with the above described, in accordance with the present invention, if the transporting path is divided into two assembly units and either one or both of the same are withdrawn as occasion demands, it is not necessary to make the assembly units or the machine body as strong, and thus not as large or heavy. In addition, in the copying machine having two-divided copy paper transporting path in accordance with the present invention, removing the copy paper is done easily because only one assembly unit of the side where a paper jam occurs is removed. More specifically, a copy paper in the paper supplying portion or the paper ejecting portion sometimes causes a paper jam with the same being able to be seen from the exterior, or the paper jam does not always occur at the intermediate portion of the transporting path. In such a case, since it is possible to know easily which assembly unit the paper jam occurs in, it is necessary only to withdraw only the assembly unit in question, and thus it is possible to remove the copy paper more easily as compared with a machine adapted to withdraw all of the transporting path. In addition, since the assembly units can be removed in opposite directions from each other, the center of gravity of the copying machine does not move very much and thus stability is enhanced.

A preferred embodiment of the present invention is structured such that a fixing apparatus includes a heating apparatus for heating a toner, and one of the two assembly units includes the above described heating apparatus and the paper ejecting portion and the other of them includes a part of the copy paper transporting path from the paper supplying portion of the heating apparatus. According to this preferred embodiment, on the occasion of a paper jam in a portion other than the heat fixing portion, since it is necessary only to draw one of the two assembly units, in which the paper jam has occurred, it is not necessary for an operator to take excessive avoid the heat by the heating means in order to prevent a burn, and thus rapid handling can be done. In addition, since the heating apparatus and the copy paper transporting path from the paper supplying portion to the heating apparatus are separated from each other, it is difficult for the heat generated by the heating apparatus to be transmitted to other portions, and thus it is rare that the other portions are influenced by the heat. Accordingly, it is preferred that the assembly unit not including a heat generating portion comprises as many portions of the copy paper transporting path as possible in accordance with the present invention.

According to another preferred embodiment of the present invention, there is provided an opening at a chassis side plate thereof, through which the copy paper transporting path can be inspected from the exterior of the machine body. This opening may be formed along at least the copy paper transporting path. According to the embodiment, as the copy paper transporting path can be inspected from the exterior, it is easy to recognize the position where a paper jam has occurred. It is thus necessary to withdraw only the assembly unit where the paper jam has occurred in order to remove the copy paper, and it is not necessary to move another assembly unit. It is also possible to remove the copy paper having caused the paper jam extremely easily and rapidly.

The preferred embodiment of the present invention is structured such that the two assembly units are provided movably on at least two parallel rails formed on the bottom plate of the machine body. The rails have the additional function of enhancing the strength of the bottom plate, and accordingly, even if the plate thickness of the bottom plate is not made so thick, there is no danger that distortion of the machine body occurs on the occasion of withdrawing the assembly units.

A pair of parallel rails are provided for each of the two assembly units. One pair of parallel rails has its length from the paper supplying end longer than at least a half of the total length of the bottom plate in the copy paper transporting direction but shorter than the total length thereof and the other pair of the parallel rails extends from the paper ejecting end and have its length longer than at least a half of the total length of the bottom plate but shorter than the total length thereof. In such a way, the rails need not be provided over all of the total length of the bottom plate in the copy paper transporting direction, and thus it is necessary only to be longer than at least a half of the total length. If so, since the four rails are arranged at the central portion in the direction of the length of the bottom plate, where the strongest rigidity is needed, in parallel in a manner to be distributed in the direction of the width of the same, it is possible to obtain the rigidity required at the portion easily.

A further preferred embodiment of the present invention is structured to pivotally support a guide cover, provided from the paper supplying end to the transferring portion, at the backward position in the drawing direction, thereby to construct the guide cover in a manner capable of being opened at the front position in the drawing direction. According to the embodiment, it is possible to remove the copy paper having caused a paper jam easily by opening the guide cover. In addition, since the guide cover is pivotally supported at the backward position in the drawing direction of the assembly units, it is not necessary to open the guide cover completely in order to remove the copy paper having caused the paper jam, and thus it is possible to minimize the length of the assembly units withdrawn.

Meanwhile, in an electrophotographic copying machine provided with a manual paper supplying portion in addition to a paper supplying cassette, the automatic paper supplying portion including the paper supplying cassette and the manual paper supplying portion are integrated to be made into one assembly unit.

A still further embodiment of the present invention is structured to include as a fixing apparatus a combination of a heating roller and a pressing roller, to divide one of assembly units into a portion including the heating roller and a portion including the pressing roller and to pivotally attach these two divided portions to each other, thereby to make it possible that to easily remove the copy paper having caused the paper jam by opening the interior of one of the assembly units. Meanwhile, if one of the assembly units is divided into two portions in such a way, which are adapted to be able to be opened, the enhancement of the efficiency of the work on the occasion of the inspection of the interior can be expected.

Meanwhile, circuit parts including a power source, or a power source unit, are integrated with one of the assembly units including the paper supplying portion, and an electric power necessary for the other of the assembly units including the heating apparatus is supplied through a connector. The connector has three-divided connector terminals, one of the connector terminals being attached to one of the assembly units, the other of the connector terminals being attached to the other of the assembly units, and the intermediate connector terminal for connecting between these two connector terminals being fixed to the machine body bottom plate at the center therebetween. The power may be distributed at a distribution point of the main body to be supplied to the two assembly units through connectors.

In addition, the power supply from one of the assembly units to the other of the assembly units or the power supply from the main body to the two assembly units may be achieved by means of a connecting cable capable of extending and contracting or a connecting cable being flexible.

According to a still further preferred embodiment of the present invention, the fixing of the assembly units to the respective attached positions is achieved by a lock mechanism. More specifically, in the assembly units, there are provided an actuating lever whose one end projects to the exterior of the machine body, a coupling lever coupled to the actuating lever in a manner capable of swinging, and a lock lever coupled to the coupling lever in a manner capable of swinging and having an engaging portion for selectively engaging an engaged portion formed in the machine body of the copying machine. The actuation of the actuating lever causes the release of the engagement relationship between the engaging portion of the lock lever and the engaged portion of the machine body of the copying machine. According to this embodiment, since it is possible to withdraw the assembly units only by actuating the actuating lever, the handling of a paper jam can be done more rapidly.

DETAILED DESCRIPTION OF THE PREFERRED EMBODIMENTS

Figure 1:
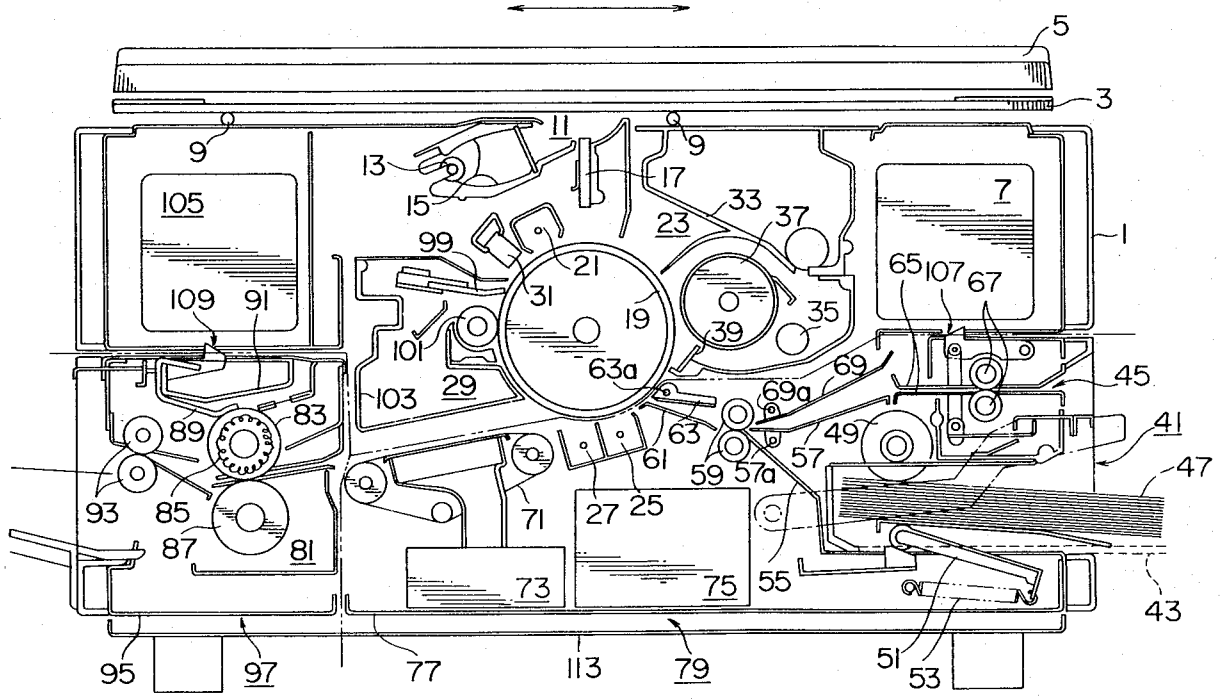
FIG. 1 is a sectional illustrative view of an electrophotographic copying machine showing the total structure of one embodiment of the present invention.

FIG. 1 is an illustrative sectional view showing the total structure of an electrophotographic copying machine in accordance with one embodiment of the present invention. On the upside of a machine body 1 there are provided an original copy carriage 3 made of a transparent glass for supporting an original copy, and an original copy carriage cover 5 attached to this original copy carrriage 3 in a manner capable of being closed and opened so as to push the original copy (not shown) on the original copy carriage 3. In this embodiment, the original copy carriage 3 and the original copy carriage cover 5 are structured to be able to move together in the direction of the arrow through rollers 9 by a prime mover 7. To the original copy (not shown) put on the original copy carriage 3, light from a light source 13 constituting optical means 11 is focused by a reflector 15 to be transmitted. The original copy image formed by the optical means 11 is projected and focused on a photosensitive drum 19 through a short focal distance lens array 17 which comprises a condensing light conductor having many bar lenses, constituting the optical means 11, arranged closely. More specifically, the surface of the original copy is illuminated by the light source 13 of the optical means 11, while the original copy carriage 3 is moved by the prime mover 7 in the direction of the arrow, and thus the optical image from the surface of the original copy is focused on the photosensitive drum 19 through the short focal distance lens array 17.

The photosensitive drum 19 is arranged near the center of the machine body 1 of the electrophotographic copying machine, and rotated by the prime mover 7 in synchronism with the movement of the original copy carriage 3. Near the periphery of the photosensitive drum 19 in the rotating direction, there are disposed an charging corotron 21, a developing apparatus 23, a transferring apparatus or a transferring corotron 25, a separating corotron 27, a cleaning apparatus 29 and a discharging lamp 31, in turn. The charging corotron 21 electrifies the surface of the photosensitive drum 19 uniformly with charge having a given polarity before an electrostatic latent image is formed on the photosensitive drum 19 by the original copy image. The developing apparatus 23 develops the electrostatic latent image formed on the photosensitive drum 19 into a visual image by a toner. The developing apparatus 23 includes a toner box 33, a toner stirrer 35, a magnetic brush 37 for supplying the toner for the photosensitive drum 19 while rotating and holding the toner on the outer periphery of a sleeve thereof by the magnetic power, and a blade 39 for unifying the toner layer on the magnetic brush. By means of the developing apparatus 23, a toner image is formed on the photosensitive drum 19.

A paper supplying portion 41 comprises a paper automatically supplying apparatus including a paper supplying cassette 43 and a paper manually supplying apparatus 45. In the paper supplying cassette 43, copy papers 47 cut to a predetermined size are stored, and from the same, the copy papers are fed out, one by one, by a paper supplying roller 49 being rotated in the clockwise direction by the prime mover 7. Meanwhile, the copy papers 47 stored in the paper supplying cassette 43 are pushed onto the paper supplying roller 49 by a pushing-up arm 51 passing through a penetrating hole formed in the bottom portion thereof. This pushing-up arm 51 is pivotally urged in the clockwise direction by a spring 53 provided at the bottom portion of the machine body, thereby to push up the copy papers 47 onto the lower portion of the paper supplying roller 49. The copy paper 47 taken into the machine body by the paper supplying roller 49 is guided between a fixed guide cover 55 and a movable guide cover 57 thereabove by the same to be brought to the position of a pair of register rollers 59. The register rollers 59 further transport the copy paper 47, which is fed by the paper supplying roller 49, to the transferring portion at the appropriate time. The movable guide cover 57 is pivotally supported by a shaft 57*a*, thereby to be capable of turning in the counterclockwise direction about the shaft 57*a*. The copy paper having passed through the register rollers 59 is guided between a fixed guide cover 61 and a movable guide cover 63 provided thereabove by the same to be brought to the transferring portion. The movable guide cover 63 is pivotally supported by a shaft 63*a*, thereby to be capable of turning in the counterclockwise direction about the shaft 63*a*. In such a way, the copy paper is automatically transported from the paper supplying cassette 43 to the position of the transferring portion or the transferring corotron 25 by the action of the paper supplying roller 49 and the register rollers 59.

On the other hand, the manual paper supplying portion 45 comprises a pair of fixed guide covers 65 between which one copy paper is inserted, the copy paper inserted between the fixed guide covers 65 being drawn by a pair of paper supplying rollers 67. The copy paper guided by the pair of fixed guide covers 65 is further guided between the movable guide cover 57 and another movable cover 69 provided thereabove by the same to be brought to the position of the register roller 59. The movable guide cover 69 is pivotally supported by a shaft 69*a*, thereby to be capable of turning in the counterclockwise direction about the shaft 69*a*. Thus, in the embodiment, it is possible to manually supply one copy paper by using the manual paper supplying portion 45.

As described above, the copy paper is brought under the photosensitive drum 19, and then the toner image formed on the photosensitive drum 19 is transferred onto the copy paper by the transferring corotron 25 for generating charge having the opposite polarity to the toner. The separating corotron 27 is used for separating the copy paper, which adheres to the photosensitive drum 19 during transfer from the same, and comprises an alternating current corona discharger, for example. The copy paper separated by the separating corotron 27 is further transported by a transporting conveyor 71 provided at the down stream side in the transporting direction. The transporting conveyor 71 comprises a mesh belt-like conveyor driven to move by the prime mover 7 and a vacuum unit 73 provided under the conveyor. The vacuum unit 73 ensures the transportation of the copy paper brought onto the mesh-like transporting conveyor 71 by suction on the copy paper. At the lower portion of the vacuum unit 73 there is provided a penetrating hole (not shown), and through the penetrating hole exhaust is achieved.

In the space under the photosensitive drum 19, there is provided a power source unit 75 for supplying necessary electric power to the copying machine therefrom. The power source unit 75 comprises, for example, a transformer, a rectifying circuit and so on, not shown in the drawings.

In this embodiment, the paper supplying portion 41, the transferring corotron 25, the separating corotron 27, the transporting conveyor 71, the vacuum unit 73 and the power source unit 75, all described above are integratedly attached onto one base plate 77 and constitute an assembly unit 79.

The copy paper having the toner image transferred is transported to a fixing apparatus 81 by the transporting conveyor 71. The fixing apparatus 81 comprises a heating roller 83 having an electric heater 85 and a pressing roller 87 for pressing the copy paper against the heating roller 83. The toner image on the copy paper is melted by the heating roller 83 to be fixed to the copy paper while the copy paper passes between the two rollers 83 and 87. Meanwhile, silicone oil is spread on the surface of the heating roller 83 by a spreading member 89 to prevent the toner from adhering to the surface of the heating roller 83. The spreading member 89 is soaked in the silicone that is stored in a storing container 91. The copy paper, which has had the toner image fixed thereto, is further guided by guide plates to be ejected to the exterior of the machine body 1 by a pair of paper ejecting rollers 93.

In this embodiment, the fixing apparatus 81, the silicone oil storing container 91, the pair of paper ejecting rollers 93 and so on are attached onto one base plate 95, and constitute one assembly unit 97.

Again, returning to the periphery of the photosensitive drum 19, each of the components disposed there will be explained. A cleaning apparatus 29 removes the toner remaining on the photosensitive drum 19 after the toner image on the drum 19 is transferred to the copy paper, and comprises a blade 99 for tearing off the remaining toner by touching the surface of the photosensitive drum, and a rubber roller 101 for letting the torn-off toner fall into a rear storing box 103. The photosensitive drum 19 having the remaining toner removed in such a way is, in addition, irradiated by the discharging lamp 31. The discharging lamp 31 causes the charge remaining on the photosensitive drum 19 to disappear. In other words, the photosensitive drum 19 comprises a photosensitive substance such as selenium, silicon or the like, the photosensitive substance indicating conductivity at the portion which receives light. Accordingly, all the surface of the photosensitive drum 19 is uniformly irradiated with light by the discharging lamp 31, and consequently all of the charge on the drum 19 is discharged.

A cooling fan 105 exhausts air, after cooling the prime mover 7 or the optical means 11, to the exterior of the machine body 1.

In the electrophotographic copying machine in accordance with the present invention structured as described above, the copy paper transporting path from the paper supplying end to the paper ejecting end is divided, as shown by two-dot chain lines in FIG. 1, into two assembly units 79 and 97. In addition, these assembly units 79 and 97 are attached slidably on respective guide rails (which are provided on the machine body bottom plate 113), not shown but described later, and thus structured to be able to be withdrawn from the predetermined attached position to the exterior of the machine body in a direction parallel to the transporting direction of the copy paper but opposite from each other. Meanwhile, these assembly units 79 and 97 are held in the predetermined attached positions by lock mechanism 107 and 109, respectively.

Figure 2:
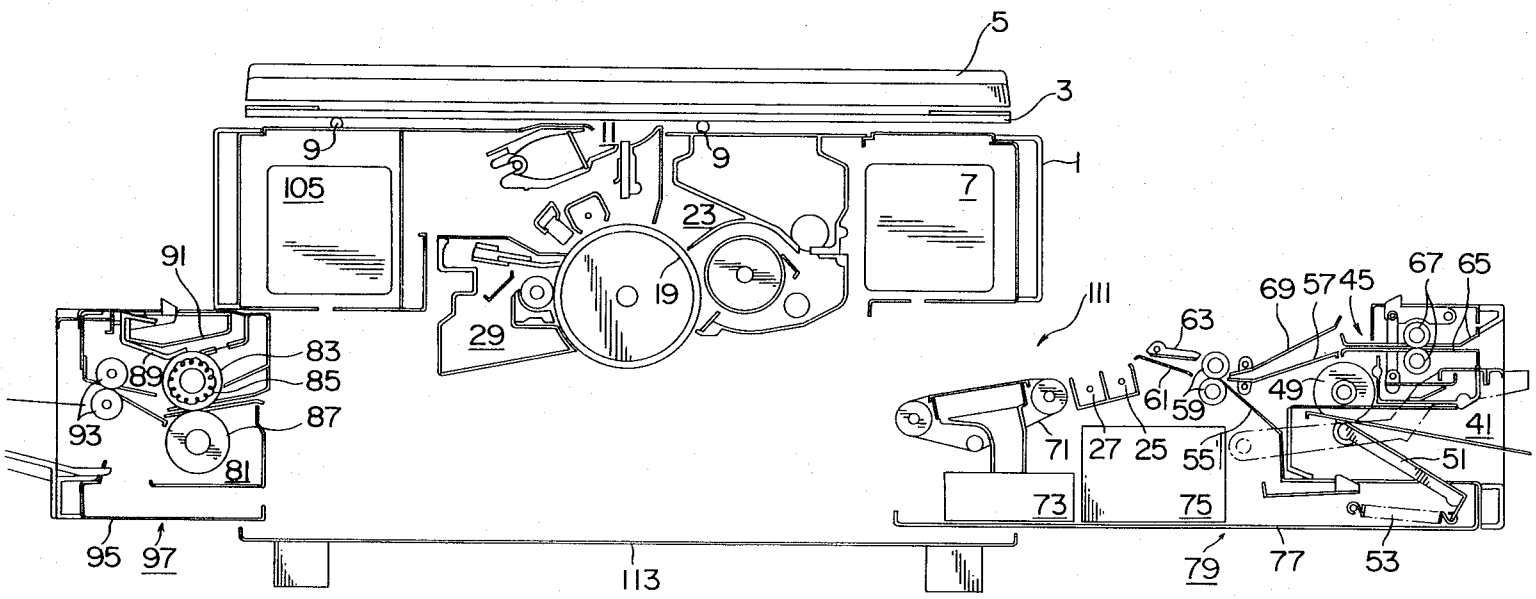
FIG. 2 is a sectional illustrative view showing the state where two assembly units are drawn in the embodiment of FIG. 1.

Thus, by dividing the transporting path of the copy paper into the two assembly units 79 and 97, and by structuring the machine to be able to withdraw each of the assembly units 79 and 97 to the exterior of the machine body in parallel with the transporting path, it becomes very easy to remove a copy paper having caused a paper jam, or the like. More specifically, when a paper jam has occurred in the transporting path from the paper supplying portion 41 to the transporting conveyor 71, as shown in FIG. 2, it is necessary only to draw the assembly unit 79 from the attached position to the exterior of the machine body to remove the copy paper having caused the paper jam. Meanwhile, it is preferred that the assembly unit 79 is withdrawn to the exterior of the machine body until the portion where the height thereof is lower than that of a drawing opening 111, such as the vicinity of the transferring portion appears, since a large gap is created between the assembly unit 79 and the drawing opening 111, whereby it is possible to remove the copy paper on the transporting conveyor 71 easily and thus to enhance the efficiency of this work.

In addition, if the paper jam has occurred near the fixing portion 81, it is necessary only to withdraw the assembly unit 97 to the exterior of the machine body 1 as shown in FIG. 2, and then remove the copy paper therein.

Thus, according to the embodiment shown in FIGS. 1 and 2, since the two assembly units 79 and 97 are structured to be able to be drawn out in a direction away from each other and in the direction parallel with the transporting direction of the copying machine, it is possible to easily remove jammed copy paper without fear that the copy paper is caught on the photosensitive drum. At this time, since the two assembly units 79 and 97 are structured to be able to be drawn out to the exterior of the machine body simultaneously if needed, it is possible to create a larger space for the work than was made available by prior art machines, and there is no fear that a human hand will come into contact with the photosensitive drum 19 due the work of removing the copy paper having caused the paper jam. Thus, as compared with any of the two prior art copying machines described above, there is an extremely significant difference. It is impossible for any of the two prior art machines to draw both of the paper supplying side and the paper ejecting side to the exterior of the machine body, and thus the space for the work for removing the copy paper is smaller than that of the present invention. There thus remains the danger that the human hand may come into contact with the photosensitive drum. In addition, according to the present invention, since it is possible to withdraw either assembly unit 79 or 97 as occasion demands, it is not necessary to move portion where the jam has not occurred for the handling of the paper jam. It is thus possible to handle the job more rapidly. Moreover, since the assembly unit 79, where the paper jam is apt to occur, does not include the heating roller for fixing the toner image, it is not necessary for the operator to be excessively careful to avoid the heat of the heating roller, and it is possible to dispose of the paper jam more safely without fears of burn or the like. However, essentially, the divided position of the copy paper transporting path in accordance with the present invention is not restricted to that of the embodiment shown in FIGS. 1 and 2, and the same may be divided into a part of the copy paper transporting path, from the paper supplying end to the photosensitive drum, and a part of the copy paper transporting path, from the photosensitive drum to the paper ejecting end, for example, to constitute the respective assembly units.

Figure 3:
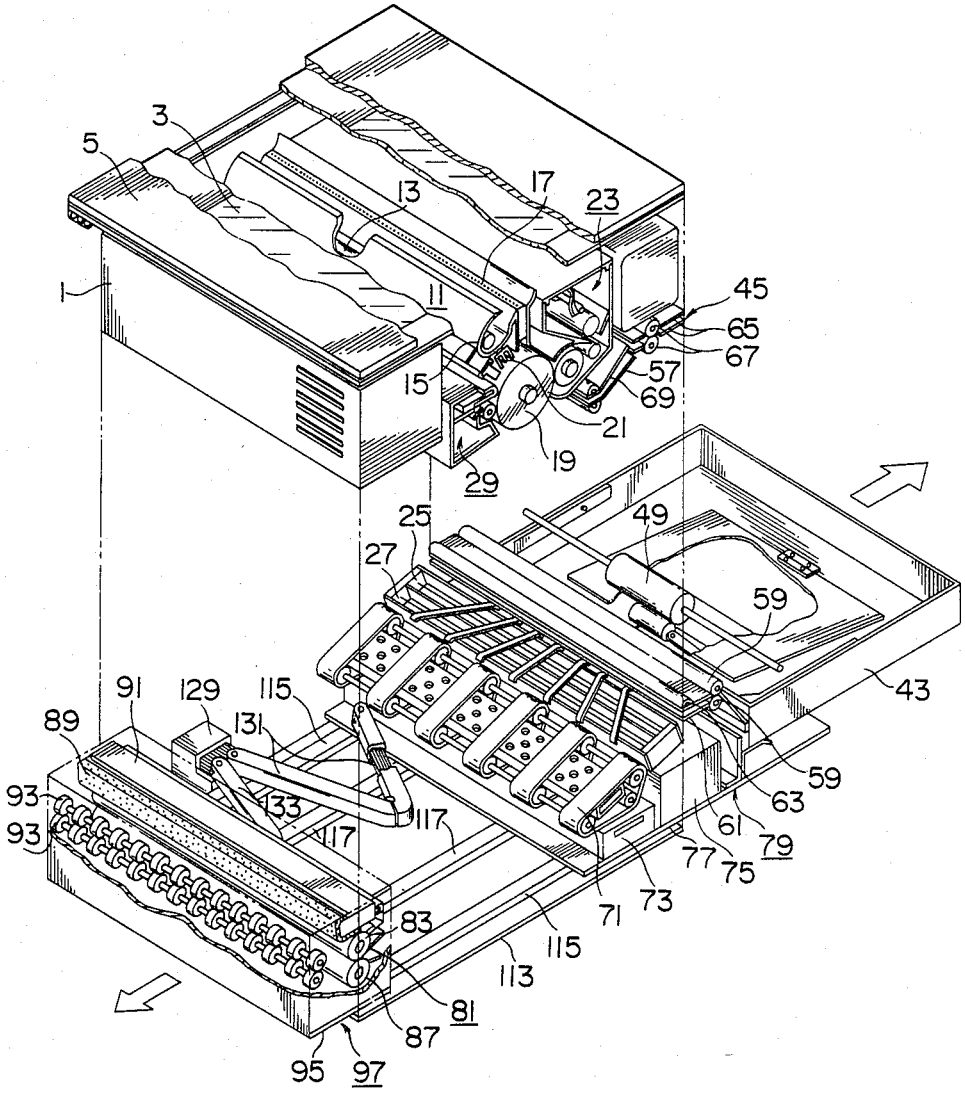
FIG. 3 is a perspective view of a major portion showing a state where the assembly units are drawn in another embodiment of the present invention.

FIG. 3 is an exploded perspective view showing another embodiment of the present invention. In this embodiment shown in FIG. 3, the assembly unit 79' does not include the manual paper supplying portion 45. More specifically, in this embodiment, a pair of fixed guide plates 65 are attached to the main body constituting the manual paper supplying portion 45, the pair of paper supplying rollers 67, and the pair of movable guide covers 57 and 69. That is, the manual paper supplying portion 45 may be attached to the assembly unit 79 integrally together with the paper supplying portion, like the above described embodiment, or may be attached with the automatic paper supplying portion separating from the same, as in the embodiment of FIG. 3.

Figure 4:
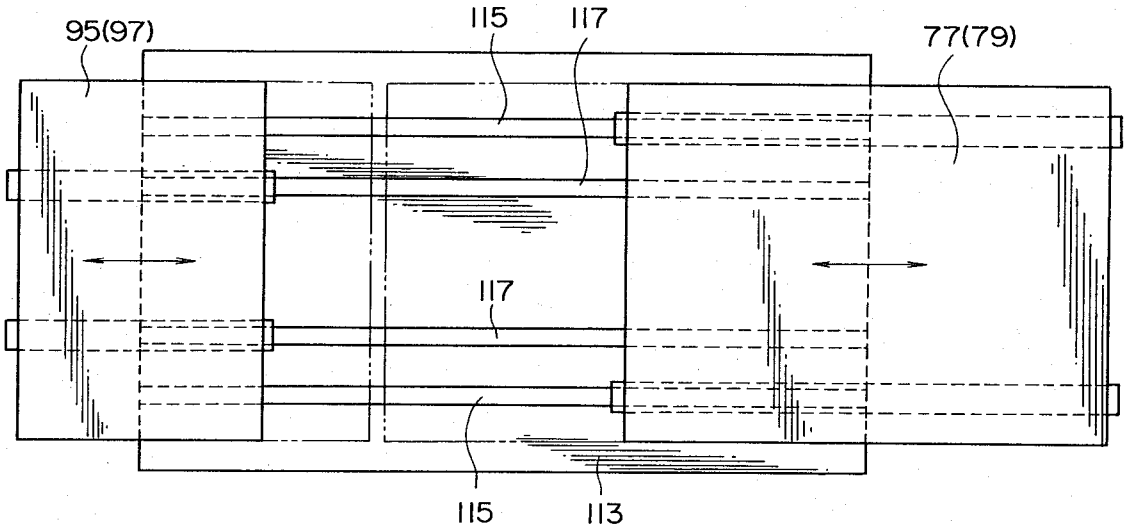
FIG. 4 is an illustrative plan view showing a supporting base (a bottom plate) having rails.
Figure 5:
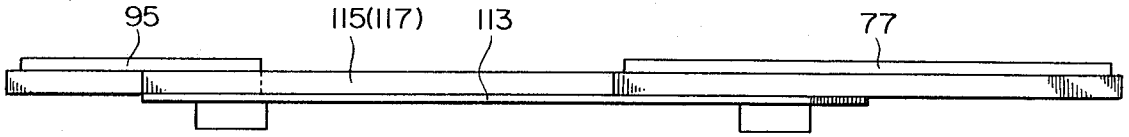
FIG. 5 is an illustrative side view of the supporting base.

Moreover, in the embodiment shown in FIG. 3, two pairs of parallel rails 115 and 117 are arranged on the machine body bottom plate 113. One pair of rails 115 are provided for the sake of one assembly unit 79, and the other pair of rails 117 are provided for the sake of the other assembly unit 97. These pairs of rails 115 and 117 extend over the total length of the bottom plate 113 in the copy paper transporting direction, as shown in FIGS. 4 and 5.

Figure 6:
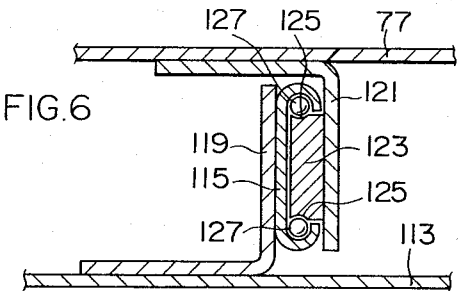
FIG. 6 is an illustrative sectional view showing the structure of the rails of the embodiment in FIG. 3.

As shown in FIG. 6, the rails 115 are each formed in a C-shaped section, and attached to the upright portion of an angle 119 fixed on the machine body bottom plate 113. On the other hand, angle 121 is attached to the underface of the base plate 77 of the assembly unit 79 in a manner to face angle 119. In addition, a rail 123 is fixed to the upright portion of the angle 121 which rail has grooves 125 formed in the upper and lower end faces thereof. Steel balls 127 intervene between the grooves 125 in the upper and lower end faces of the rail 123, and the rail 115 having the C-shaped section. The balls 123 have a function of reducing the frictional resistance on the occasion of the relative movement of the rails 115 and 123. In such a way, the base plate 77, or the assembly unit 79 is structured to be able to move in the direction parallel with the copy paper transporting direction. Meanwhile, the moving mechanism of the other assembly unit 97 is structured similarly to that of assembly unit 79. Thus, since the pair of rails are provided over the total length of the machine body bottom plate 113, the same achieves the function of increasing the strength of the bottom plate. Accordingly, even if the plate thickness of the bottom plate is not very thick, a sufficient rigidity can be obtained. In this embodiment, moreover, since the rails 115 and 123 are uprightly provided for the bottom plate 113 through the angle, the same can withstand downward bending stress, and thus the same is not bent by the weight thereof when assembly units 79 and 97 are drawn out.

In the embodiment shown in FIG. 3, the supply of the electric power from the power source unit 75 included in assembly unit 79 to the other assembly unit 97 is achieved through connection cables. More specifically, a junction point 129 is fixedly provided on a part of the machine body bottom plate 113, and a flexible connection cable 131 is connected between the junction point 129 and the power source unit 75, while a connection cable 133 is connected between the junction point 129, and the fixing apparatus 81 and so on included in the assembly unit 97. Accordingly, it is possible to supply the electric power from the power source unit 75 to an electric heater included in the fixing apparatus, through the connection cable 131, the junction point 129 and the connection cable 133.

Alternatively, the power supplying portion may be provided in the machine body 1, and may supply the electric power to each of the assembly units 79 and 97 through the junction point 129, and the respective connection cables 131 and 133.

Figure 7:
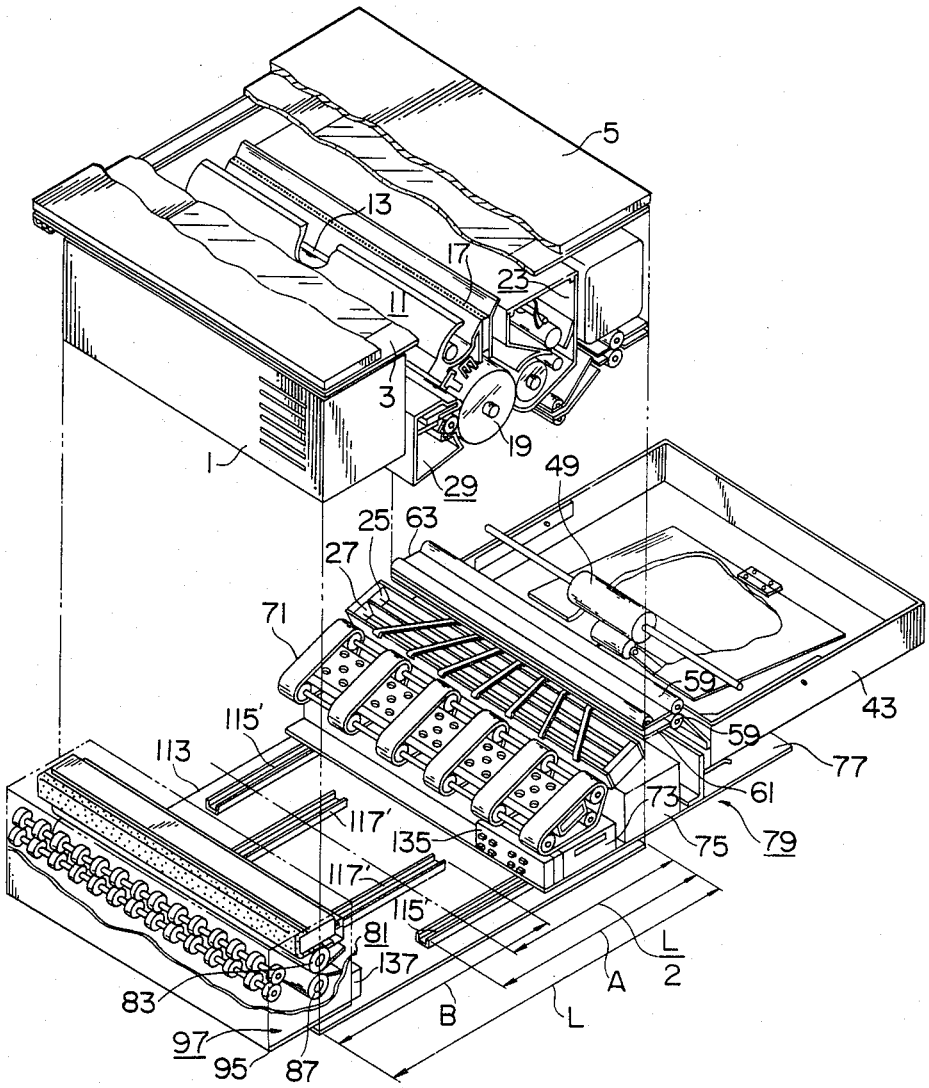
FIG. 7 is a perspective view of a major portion showing a state where the assembly units are drawn in a further embodiment of the present invention.

FIG. 7 is an exploded perspective view of a major portion showing a further embodiment of the present invention. The embodiment shown in FIG. 7 is different from the embodiment shown in FIG. 3 with respect to the following points. More specifically, in the embodiment of FIG. 7, the supply of the electric power from one assembly unit 79 to the other assembly unit 97 is achieved through connector terminals 135 and 137. One connector terminal 135 is a male-type terminal connected to the power source unit 75 included in the assembly unit 79. The other connector terminal 137 is a female-type terminal corresponding to the female-type terminal 135. Accordingly, if and when the assembly units 79 and 97 are fixed to the respective predetermined attached positions for the copying operation, the connector terminals 135 and 137 are electrically connected therebetween and the electric power can be supplied from the power source 75 to the electric heater of the fixing apparatus.

Moreover, in contrast with the pairs of rails 115 and 117 being disposed over the total length of the machine body bottom plate 113 in the copy paper transporting direction in the embodiment shown in FIG. 3, the respective lengths A and B of the pairs of rails 115' and 117' are shorter than the total length L of the machine body bottom plate 113. The pair of rails 115' for one assembly unit 79 has the length A extending from the paper supplying end side to the paper ejecting end side. On the other hand, the pair of rails 117' for the other assembly unit 97 has the length B extending from the paper ejecting end side to the paper supplying end side. Each of these lengths A and B is longer than a half of the total length L of the machine body bottom plate 113, or L/2, but shorter than the total length L, thereby to enable material to be saved. In addition, since each of the pairs of the rails 115' and 117' is longer than the length L/2, the four rails are arranged near the center of the machine body bottom plate 113 in parallel with each other and at some intervals in the direction of width thereof, whereby a sufficient rigidity to the center portion of the machine body bottom plate can be obtained, and thus there occurs no problem even if the rails are not provided over the total length thereof. The reason is that, when the copy paper transporting path is divided into the two assembly units and the assembly is structured to be able to draw out each of them in the direction parallel with the copy paper transporting direction in accordance with the present invention, though a considerable rigidity is needed near the center of the machine body bottom plate 113 owing to large moment applied thereto, a large rigidity is not needed at other portions.

Figure 8:
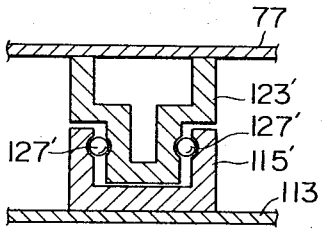
FIG. 8 is an illustrative sectional view showing the structure of the rails of the embodiment in FIG. 7.

Moreover, in the embodiment shown in FIG. 7, the shape of the rails 115' and 117' is different from that of the embodiment in FIGS. 3 and 6. Accordingly, the moving mechanism of the assembly units 79 and 97 is modified to that shown in FIG. 8. More specifically, the rail 115' is fixed to the bottom plate 113, while the rail 123' engaging with the rail 115' is attached to the base plate 77. The balls 125' and 127' intervene between the outer side of the rail 123' and the inner side of the rail 115', and are held therebetween by the grooves.

Figure 9:
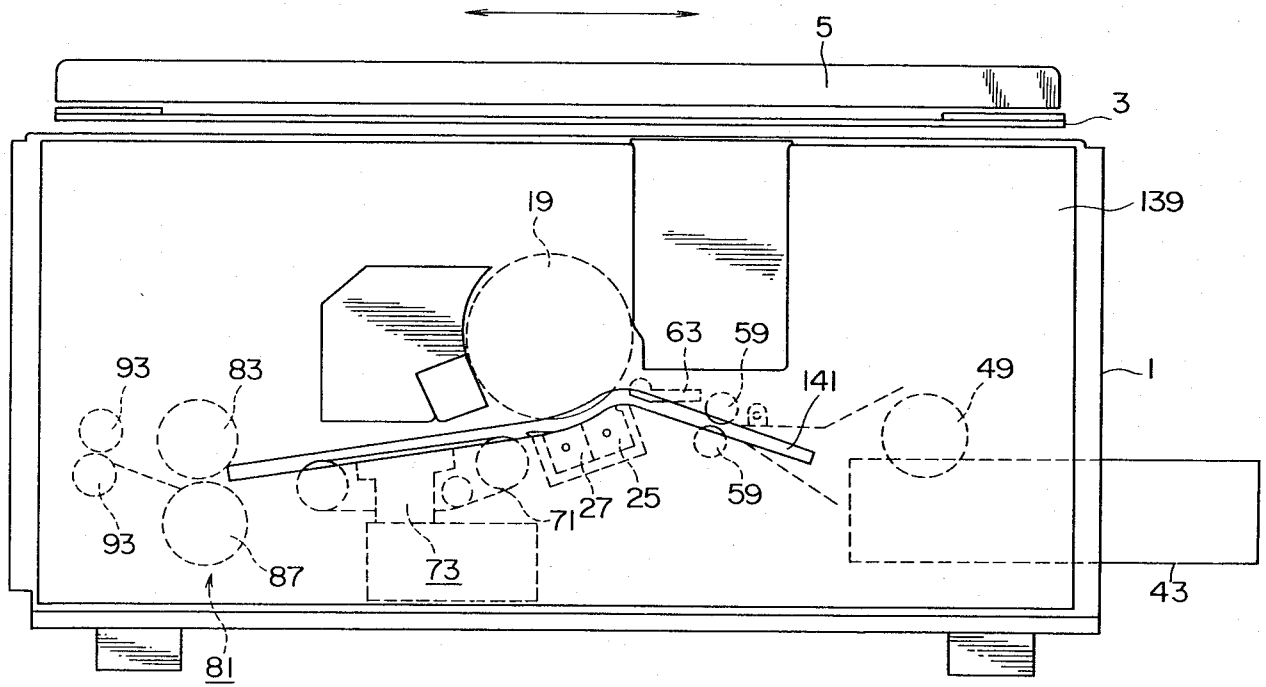
FIG. 9 is a side view showing a slit-like opening along a copy paper transporting path in accordance with the preferred embodiment of the present invention.

FIG. 9 is a side view showing another preferred embodiment of the present invention. This embodiment and an embodiment shown in FIG. 10 later described are each structured such that the transporting path of the copy paper can be inspected from the outside, and thus it is possible to easily recognize the position where a paper jam occurs. In the embodiment shown in FIG. 9, on the chassis side plate 139 of the machine body 1, there is formed a slit-like opening 141 along the transporting path of the copy paper. The opening 141 needs only to be structured such that the copy paper transporting path at least from the up-stream side of the register roller 59 in the copy paper transporting direction to the fixing apparatus 81 may be inspected from the outside, since more paper jams occur in the copy paper transporting path therebetween. In short, it is necessary only to be able to recognize from the outside the portion where the paper jam is apt to be generated. In addition, it is necessary only to recognize the position, where the paper jam occurs, through the above described opening 141 to draw out the appropriate one of the two assembly units.

Figure 10:
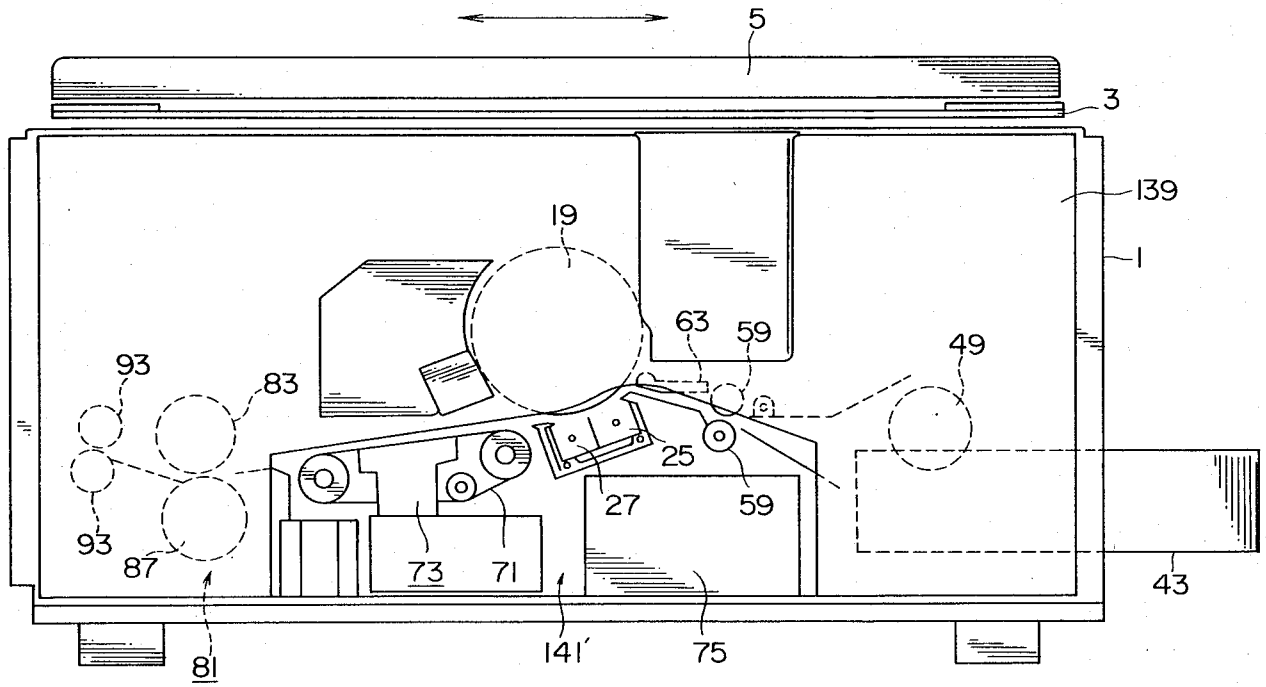
FIG. 10 is a side view showing another example of the opening.

In the embodiment shown in FIG. 10, at the chassis side plate 139 there is formed a larger opening 141'. More specifically, the opening 141' is formed over the extensive region from the copy paper transporting path to the machine body bottom plate 113. Accordingly, in this embodiment, even when a part of the copy paper having caused the paper jam remains inside of the main body, it is possible to remove the same easily by inserting a hand through the opening 141' after drawing out either of the assembly units. Although there is hardly such a case owing to the capability of drawing out each of the assembly units 79 and 97 in accordance with the present invention, for example, when, on the occasion of the paper jam having occurred in the fixing apparatus 81, the copy paper having caused the paper jam is largely projecting to the center of the interior of the main body, it is possible to remove the copy paper having caused the paper jam easily by inserting the hand through the opening 141' after drawing out the assembly unit 79. Meanwhile, in this case, since each of the assembly units 79 and 97 is drawn to the exterior of the machine body 1, a large space is created under the photosensitive drum 19, and thus there is no fear that the human hand comes into contact with the photosensitive drum 19.

Figure 11:
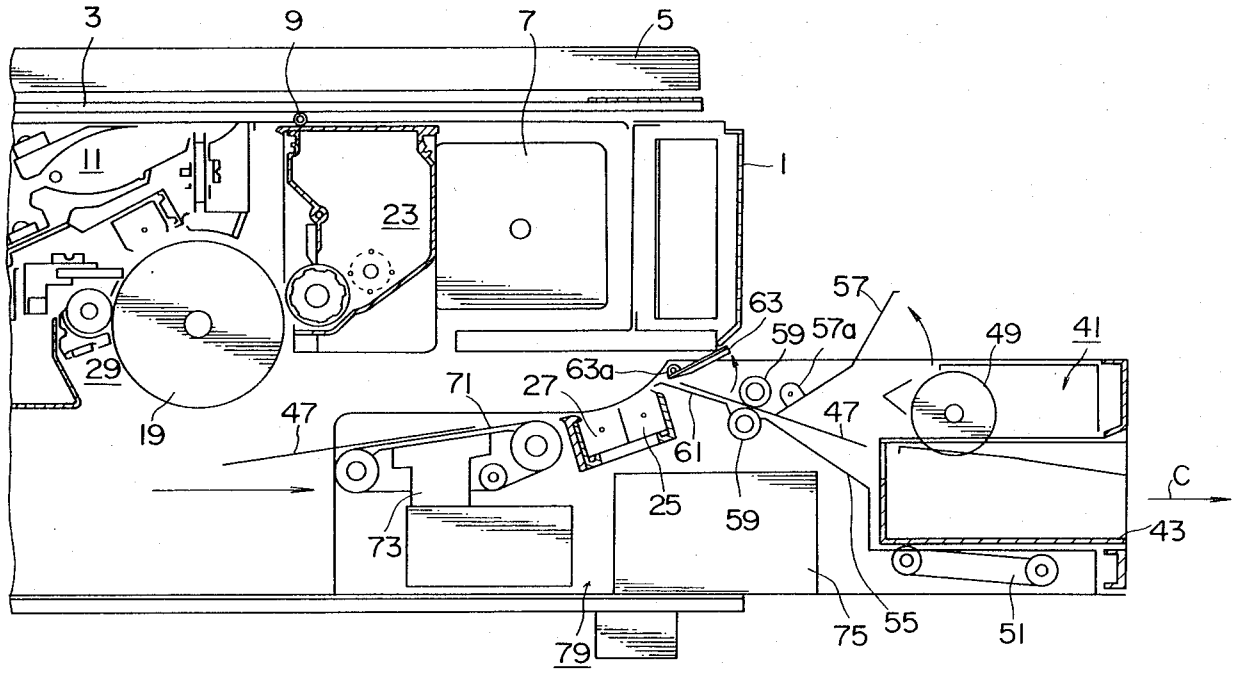
FIG. 11 is an illustrative sectional view of a major portion showing a state where one of the assembly units is drawn and a guide cover included therein is opened.

FIG. 11 is an illustrative sectional view of a major portion showing another preferred embodiment of the present invention. This embodiment is an embodiment structured such that it is possible to easily remove the copy paper having caused the paper jam on the occasion of the paper jam having occurred particularly in the paper supplying portion 41. In other words, the movable guide covers 57 and 63 provided in the assembly unit 79 are each structured to be able to be opened. More specifically, the guide covers 57 and 63 are pivotally supported by shafts 57*a* and 63*a*, respectively, and may be opened in the counterclockwise direction by lifting the respective free end portions. Meanwhile, the pivoting shafts 57*a* and 63*a* of the movable guide covers 57 and 63 are selected to be located at the respective rear portions of the guide covers 57 and 63 in the drawing direction of the assembly unit 79 (shown by the arrow C). Accordingly, in this embodiment, it is possible to easily remove the copy paper having caused the paper jam by opening the movable guide covers 57 and 63 in the counterclockwise direction. In addition, the pivoting shafts 57*a* and 63*a* of the guide covers 57 and 63 are disposed at the rear portions in the drawing direction of the assembly unit, so that it is possible to remove the copy paper 47 without opening the guide covers 57 and 63 completely, and thus it is possible to minimize the length for drawing the assembly unit 79.

Figure 12:
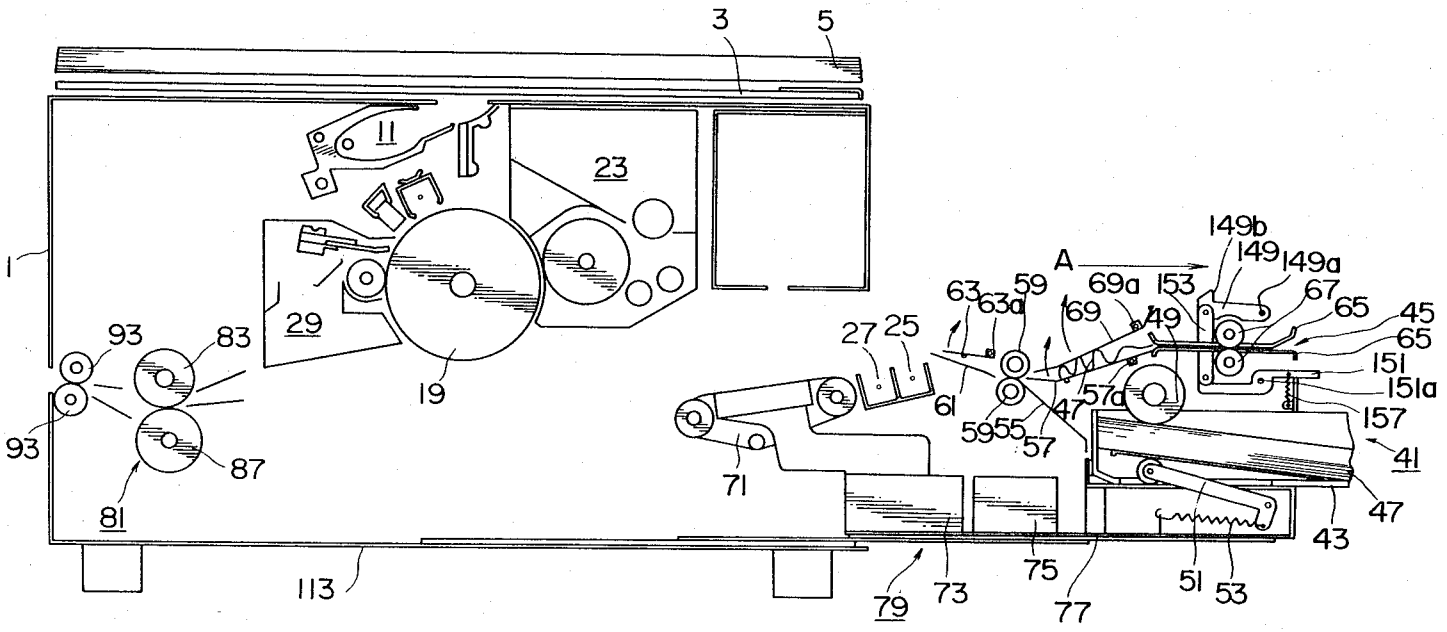
FIG. 12 is an illustrative sectional view showing a state where one of the assembly units is drawn in the embodiment on the occasion of a manual paper supplying portion included in one of the assembly units.

Moreover, if the manual paper supplying portion 45 in addition to the automatic paper supplying portion can be drawn as the assembly unit 79, the guide cover 69 also may be structured to be able to be opened, like the embodiment shown in FIG. 1 (FIG. 2). Moreover, these guide covers 57, 69 and 63 may be structured to be rotatably pivoted at the front positions in the drawing direction of the assembly unit 79, as shown in FIG. 12. According to the embodiment, on the occasion that the paper supplied from the manual paper supplying portion 45 one by one causes the paper jam, it is possible to easily remove the copy paper since the movable guide cover 57, 69 and 63 can be opened.

Figure 13:
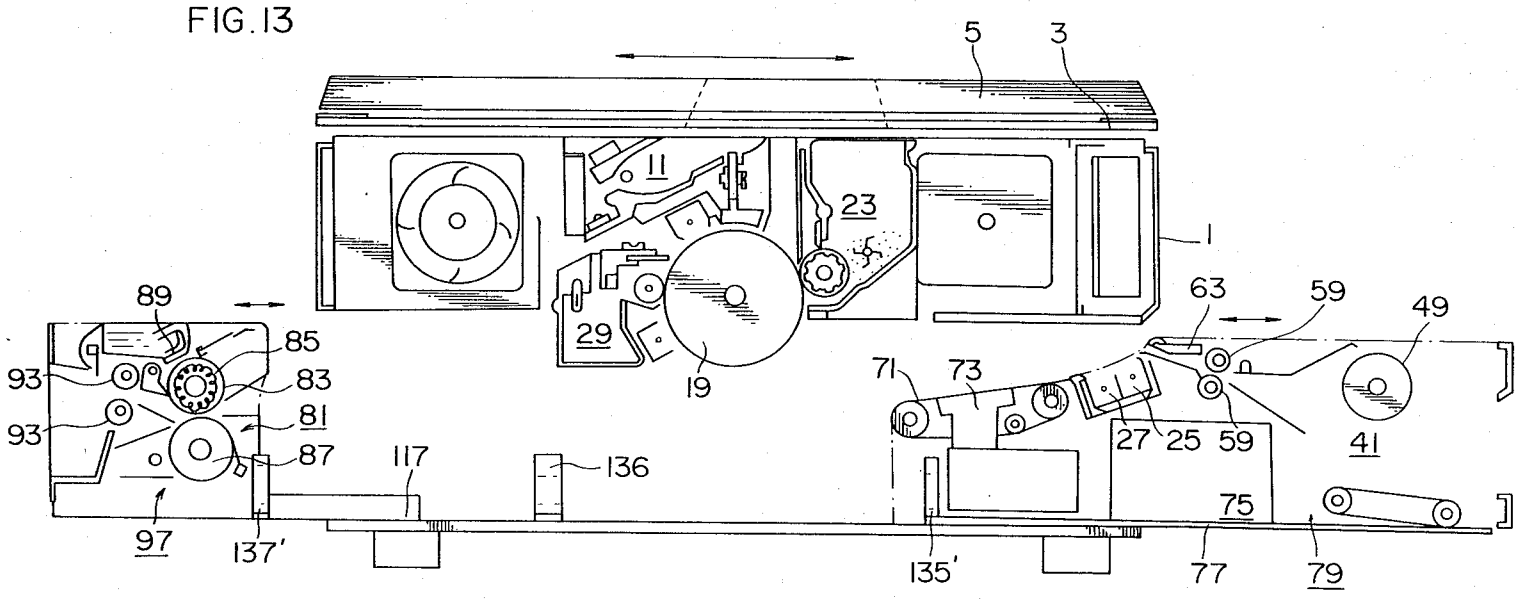
FIG. 13 is an illustrative sectional view showing another example for supplying electric power to the assembly units and showing a state where the two assembly units are withdrawn.

FIG. 13 is an illustrative sectional view showing another example for supplying the electric power from the assembly unit 79 to the assembly unit 97. In this embodiment, three connector terminals, 135', 136 and 137' are employed. One connector terminal 135' is fixed on the base plate 77 of the assembly unit 79, to which the electric power is supplied from the power source unit 75. The connector terminal 137' is attached to the base plate 95 of the other assembly unit 97. In addition, a junction connector terminal 136 for coupling these connector terminals 135' and 137' to each other is fixed at a predetermined position on the machine body bottom plate 113. Thus, when the two assembly units 79 and 97 are attached to the respective predetermined positions, the connector terminals 135', 136 and 137' are electrically connected to each other, and then the electric heater 85 included in the assembly unit 97 is supplied with the electric power from the power source unit 75 provided in the other assembly unit 79. As described above, since no connection cable is needed, as well as the above described embodiment in FIG. 7, by achieving the necessary electric connection by means of the connector terminals, there is no fear of occurrence of breakdown even if the operation for drawing the assembly units or for attaching the same to the predetermined positions is repeated. In such an embodiment, since no connection cable is used, tiresome work for cutting the cable and so on is not needed even if the two assembly units must be drawn completely on the occasion of repair.

Meanwhile, the power source unit 75 may be provided for the machine body 1, and the electric power may be supplied for each of the assembly units 79 and 97 through the junction connector 136. Incidentally, the power source unit 75 may be provided for the assembly unit 79, and the electric power may be distributed to both the assembly units 79 and 97 by using the junction connector 136 as a dispatcher.

Figure 14:
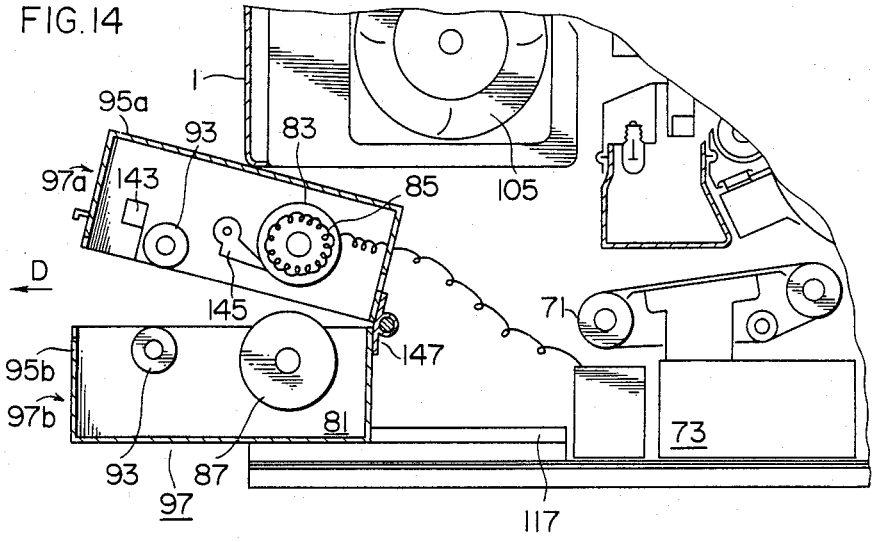
FIG. 14 is an illustrative sectional view of a major portion showing a state where the other of the assembly units is withdrawn and the two portions are opened in another embodiment of the present invention.

FIG. 14 is an illustrative sectional view at a major portion showing another embodiment of the present invention. This embodiment is structured such that particularly the assembly unit 97 is divided into two portions 97*a* and 97*b*, and these two portions 97*a* and 97*b* are pivotally attached to each other. The assembly unit 97 can move in substantially parallel with the transporting path of the copy paper along the guide rails 117, and can be drawn to the exterior of the machine body. The assembly unit 97 is divided into the first portion 97*a* and the second portion 97*b*, which are integrated with the respective independent plates 95*a* and 95*b*. The first portion 97*a* includes the heating roller 83, one roller out of the pair of paper ejecting rollers 93, a detecting switch 143 for detecting the pass of the copy paper, and a separating ratchet 145 for separating the copy paper from the heating roller 83 after fixing, which adheres to the same. The second portion 97*b* includes the pressing roller 87, the other roller out of the pair of paper ejecting rollers 93, and so on. In addition, these first and second portions are pivotally attached to each other by means of a hinge 147 on the rear side in the drawing direction of the assembly unit 97 (shown by the arrow D).

Thus, on the occasion of the paper jam in the interior of the assembly unit 97, the assembly unit 97 is moved in the direction of the arrow D, and then opened so as to separate the first portion 97*a* and the second portion 97*b* from each other. Accordingly, the assembly unit 97 is moved to the exterior of the machine body 1 and the interior thereof is opened, so that it is possible for an operator to easily and efficiently remove the copy paper having caused the paper jam. In addition, since the first portion 97*a* and the second portion 97*b* are structured to be able to be opened, it is expected that the efficiency of the work for inspecting the interior thereof, and the handling of the paper jam, is also enhanced. Moreover, since the pivoted portion 147 of the first portion 97*a* and and second portion 97*b* is selected to be disposed at the rear portion in the drawing direction of the assembly unit 97, it is possible to inspect the interior thereof sufficiently only by drawing out a part of the assembly unit 97 without drawing out the same fully, and thus it is possible to minimize the length for drawing out the assembly unit 97.

Figure 15:
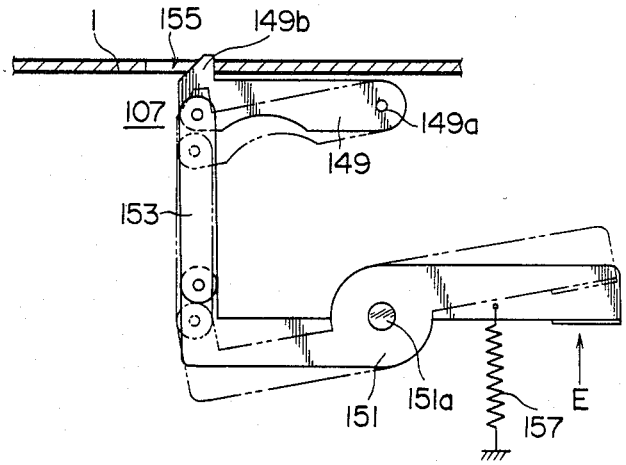
FIG. 15 is an illustrative view of a major portion showing an example of a lock mechanism for holding the assembly units at predetermined attached positions.

FIG. 15 is an illustrative view of a major portion showing a preferred embodiment of the present invention. The figure shows the lock mechanism 107 of the embodiment in FIG. 1, in detail. More specifically, the lock mechanism 107 comprises a lock lever 149, an actuating lever 151 and a coupling lever 153. The lock lever 149 is pivotally supported by a shaft 149*a*, and has an engaging portion 149*b* at the point thereof. The engaging portion 149*b* of the lock lever 149 is adapted to be able to engage and disengage with an engaged hole 155 provided for the machine body 1. One end of the actuating lever 151 is projecting to the exterior of the machine body, and the other end of the same is coupled to the lock lever 149 by the coupling lever 153. The actuating lever 151 is pivotally supported by a shaft 151*a*. In addition, the actuating lever 151 is usually urged to rotate in the clockwise direction by a spring 157.

In order to release the engagement between the engaging portion 149*b* of the lock lever 149 and the engaged hole 155, the actuating lever 151 is pushed up in the direction of the arrow E against the urging force of the spring 157. Then, as shown by two-dot chain lines in FIG. 15, the actuating lever 151 is rotated about the shaft 151*a* in the counterclockwise direction, and the lock lever 149 coupled to the actuating lever 151 through the coupling lever 153 is also rotated about the shaft 149*a* in the counterclockwise direction. Accordingly, the engaging relationship between the engaging portion 149*b* of the lock lever 149 and the engaged hole 155 is released. Thereafter, it is necessary only to draw the assembly unit 79 (97) to the exterior of the machine body in the above described condition.

Then, after removing the copy paper having caused the paper jam, if the assembly unit 79 is pushed into the interior of the machine body, the engaging portion 149*b* of the lock lever 149 and the engaged hole 155 automatically come to engage again with each other by the tension of the spring 157. Therefore, according to the embodiment, since, if the assembly unit is drawn out while actuating lever 151 being pushed up, the paper supplying portion is drawn to the exterior of the machine body, it is possible to draw the portion, where a paper jam occurs, to the exterior of the machine body by a one-touch-operation, and thus it is possible to make the rapid handling. Incidentally, if the assembly unit 79 is pushed so as to be attached to the predetermined position, the engaging portion 149*b* of the lock lever 149 and the engaged hole 155 automatically come to be in the engaging relationship, and thus it is not necessary to make another operation for fixing the assembly unit 79.

Since the lock mechanism 109 (FIG. 1) on the side of the assembly unit 97 is similarly structured, the detailed explanation thereabout is omitted.

What is claimed is:

1. An electrostatic copying machine for copying images onto copy paper comprising a machine body having an exterior and having first and second opposite exterior sides, copy paper supplying means for supplying said copy paper, a photosensitive drum on which an electrostatic image is formed, a supply of toner, developing means for developing said electrostatic image into a toner image formed from said toner, means for transferring said toner image onto said copy paper, fixing means for fixing said toner image which has been transferred onto said copy paper to provide a fixed image thereon, and means for ejecting from said machine body second exterior side, said copy paper having said fixed image, wherein:

a copy paper transporting path is defined between said copy paper supplying means and said ejecting means in a first direction therebetween;

first and second machine body assemblies;

a first portion of said copy paper transporting path being disposed on said first assembly and a second portion of said copy paper transporting path being disposed on said second assembly;

said copying machine further comprising means for movably supporting said first and second assemblies, said first and second assemblies being movable in a direction substantially parallel to said first direction and away from each other to said machine body exterior.

2. The electrophotographic copying machine in accordance with claim 1, wherein said fixing means includes heating means for heating and melting the toner image on the copy paper, and said first assembly includes said fixing means and said paper ejecting means and said second assembly includes said copy paper transporting path from said copy paper supplying means to said fixing means.

3. The electrophotographic copying machine in accordance with claim 1 or 2, further including:

a chassis side plate covering the copy paper transporting path; and an opening formed in said chassis side plate for making the copy paper transporting path visible from the exterior.

4. The electrophotographic copying machine in accordance with claim 3, wherein said opening is a slit-like opening formed along said copy paper transporting path.

5. The electrophotographic copying machine in accordance with claim 3, wherein said opening is an opening from the copy paper transporting path to the bottom portion of the chassis side plate.

6. The electrophotographic copying machine in accordance with claim 2, further comprising a guide member for guiding the copy paper, supplied from the paper supplying means, at said copy paper transporting path on said second assembly unit.

7. The electrophotographic copying machine in accordance with claim 6, wherein said guide member includes a fixed guide plate provided under said copy paper transporting path and a movable guide cover provided above said copy paper transporting path, and said movable guide covers are pivotally supported at the rear end in the drawing direction of said second assembly means by respective pivoting shafts, thereby to be structured to be capable of being opened.

8. The electrophotographic copying machine in accordance with claim 7, wherein said paper supplying means includes a manual paper supplying portion, said manual paper supplying portion comprises a movable guide cover provided further above said movable guide cover of said copy paper transporting path, and said movable guide cover is pivotally supported at the rear end in the drawing direction of said second assembly by a pivoting shaft, thereby to be capable of being opened.

9. The electrophotographic copying machine in accordance with claim 1, wherein said supporting means includes:

at least two parallel rails arranged on said machine body bottom plate in said direction substantially parallel with said copy paper transporting direction; and rail members provided for said two assembly units and adapted to be able to engage with said at least two parallel rails.

10. The electrophotograpic copying machine in accordance with claim 9, wherein at least one pair of parallel rails are provided for each of said two assembly units, the respective pair of rails for one and the other of said two assembly units are provided extending over predetermined lengths (A, B) from one end and the other end of the machine body, respectively, and said machine body having a body length L, said predetermined length (A, B) are selected to be $L/2<A<L$ and $L/2<B<L$, respectively.

11. The electrophotographic copying machine in accordance with claim 9, wherein said at least two rails are provided over from one end to the other end of said machine body.

12. The electrophotographic copying machine in accordance with claim 1, wherein said paper supplying portion means comprises automatic paper supplying means including a paper supplying cassette.

13. The electrophotographic copying machine in accordance with claim 12, wherein said paper supplying means includes a manual paper supplying means, and said manual paper supplying means is attached onto one of said assemblies together with said automatic paper supplying means.

14. The electrophotographic copying machine in accordance with claim 1, wherein, one of said assembly means includes two portions and means for pivotally connecting said two portions to each other.

15. The electrophotographic copying machine in accordance with claim 14, wherein said means for pivotally connecting said two portions to each other is provided on a rear side in said moving direction of said assembly.

16. The electrophotographic copying machine in accordance with claim 14, wherein said assembly includes said fixing means and a pair of paper ejecting rollers, said fixing means includes a heating roller and a pressing roller, and one of said two portions includes said heating roller and one of said pair of paper ejecting rollers, and the other portion of the same includes said pressing roller and the other of said pair of paper ejecting roller.

17. The electrophotographic copying machine in accordance with claim 1, further comprising:

a power source unit provided for one of said two assemblies; and means for supplying electric power from said power source unit to the other of said assemblies when the two assemblies are attached to the respective predetermined positions.

18. The electrophotographic copying machine in accordance with claim 17, wherein said means for supplying the electric power includes a junction point provided at a predetermined position on the machine body bottom place, a connection cable connecting said power source unit and said junction point to each other and being flexible, and a flexible connection cable connected to said connection cable through said junction point and connected to the other assembly unit.

19. The electrophotographic copying machine in accordance with claim 17, wherein said means for supplying the electric power includes a junction connector terminal fixed to a predetermined position on the machine body bottom plate, a first connector terminal provided on one assembly unit at a position corresponding to said junction connector terminal and electrically connected to said power source unit, and a second connector terminal provided on the other assembly unit at a position corresponding to said junction connector terminal.

20. The electrophotographic copying machine in accordance with claim 17, wherein said means for supplying the electric power includes a first connector terminal provided on one assembly unit and electrically connected said power source unit, and a second connector terminal provided on the other assembly unit at a position corresponding to said first connector terminal.

21. The electrophotographic copying machine in accordance with claim 1, further comprising:

a power source unit provided for the machine body; and means for supplying electric power from the power source unit to said first and second assemblies.

22. The electrophotographic copying machine in accordance with claim 1, wherein first and second assemblies are held at their predetermined attached positions by a lock mechanism.

23. An electrophotographic copying machine in accordance with claim 22, wherein said lock mechanism includes:

an actuating lever having one end projecting to the exterior of the machine body;

a coupling lever swingably coupled to said actuating lever; and a lock lever swingably coupled to said coupling lever, and having an engaging portion capable of engaging and disengaging with an engaged portion formed in said copying machine main body;

and the engaging relationship between said engaged portion of said lock lever and said engaged portion of the copying machine main body is released by actuating said actuating lever.

* * * * *